US011802397B2

(12) United States Patent
Zhang et al.

(10) Patent No.: US 11,802,397 B2
(45) Date of Patent: Oct. 31, 2023

(54) DUAL-HANDLE AND DUAL-CONTROL FAUCET

(71) Applicant: Xiamen Forbetter Sanitary Ware Co., Ltd., Fujian (CN)

(72) Inventors: Xingui Zhang, Xiamen (CN); Yihui Chen, Xiamen (CN); Mouyong Lin, Xiamen (CN)

( * ) Notice: Subject to any disclaimer, the term of this patent is extended or adjusted under 35 U.S.C. 154(b) by 77 days.

(21) Appl. No.: 17/547,256

(22) Filed: Dec. 10, 2021

(65) Prior Publication Data

US 2023/0183956 A1 Jun. 15, 2023

(51) Int. Cl.
*E03C 1/05* (2006.01)
*E03C 1/04* (2006.01)

(52) U.S. Cl.
CPC ..... *E03C 1/057* (2013.01); *E03C 1/0412* (2013.01); *Y10T 137/87676* (2015.04); *Y10T 137/9464* (2015.04)

(58) Field of Classification Search
CPC ..... Y10T 137/9464; Y10T 137/87676; E03C 1/0412; E03C 1/057
See application file for complete search history.

(56) References Cited

U.S. PATENT DOCUMENTS 11,408,156 B2 * 8/2022 Zhang ..... F16K 19/006
11,661,728 B2 * 5/2023 Czerwinski, Jr. ..... E03C 1/055 4/676
11,702,826 B2 * 7/2023 Song ..... G01S 17/04 4/675
2011/0240900 A1 * 10/2011 Gordon ..... E03C 1/0412 251/339
2012/0017367 A1 * 1/2012 Reeder ..... E03C 1/057 4/597
2012/0227843 A1 * 9/2012 Thomas ..... B29C 45/0003 137/603
2013/0181440 A1 * 7/2013 Dai ..... F16K 19/006 285/124.2
2016/0060851 A1 * 3/2016 Lu ..... E03C 1/021 137/603
2017/0342691 A1 * 11/2017 Yan ..... F16K 47/023
2019/0271141 A1 * 9/2019 Green ..... F16K 31/62
2019/0328204 A1 * 10/2019 Yan ..... B01F 23/49
2019/0330828 A1 * 10/2019 Yan ..... E03C 1/057
2021/0340743 A1 * 11/2021 Zhang ..... F16K 31/60
2022/0064918 A1 * 3/2022 Zhang ..... F16K 31/60
2022/0307244 A1 * 9/2022 Ye ..... E03C 1/057
2022/0325817 A1 * 10/2022 Yang ..... F16K 31/0603

* cited by examiner

*Primary Examiner* — Daphne M Barry
*Assistant Examiner* — Frederick D Soski

(57) ABSTRACT

A dual-handle and dual-control faucet includes a faucet body and a faucet spout, a mechanical control unit, a sensor control unit, a water flow sensor and a controller that are mounted to the faucet body. The controller detects whether the mechanical control unit is operated through the water flow sensor. When the mechanical control unit acts, the sensor control unit becomes inactive. The faucet has a mechanical control mode and a sensor control mode and is convenient to use.

12 Claims, 15 Drawing Sheets

DUAL-HANDLE AND DUAL-CONTROL FAUCET

BACKGROUND OF THE INVENTION

1. Field of the Invention

The present invention relates to a faucet, and more particularly to a dual-handle and dual-control faucet

2. Description of the Prior Art

In order to improve the user's experience, a dual-handle automatic faucet is developed on the market. (For example, Chinese Patent Publication No. CN213508711U discloses a dual-handle automatic faucet). The cold and hot switches of a conventional dual-handle automatic faucet are arranged separately. The water flow of the dual-handle automatic faucet is controlled by the cooperation of a sensor and a solenoid valve core. The conventional dual-handle automatic faucet has the effects of accurate temperature adjustment and a sensor control mode, so that there is no need for the user to adjust the water temperature many times. It is convenient for the user to use.

However, the conventional dual-handle automatic faucet still has defects. That is, when the sensor control mode of the dual-handle automatic faucet is abnormal (such as power failure or damage to the solenoid valve core or sensor), the dual-handle automatic faucet cannot spray water normally. As a result, the user cannot use the faucet for water demand.

SUMMARY OF THE INVENTION

The primary object of the present invention is to provide a dual-handle and dual-control faucet, which has a mechanical control mode and a sensor control mode and is convenient to use.

In order to achieve the above object, the present invention adopts the following solutions.

A dual-handle and dual-control faucet comprises a faucet body, a faucet spout, a mechanical control unit, a sensor control unit, a water flow sensor, and a controller. The faucet body has a first inlet water channel, a second inlet water channel, a third inlet water channel, a mixed water channel, and a main outlet water cavity. An outlet end of the first inlet water channel and an outlet end of the second inlet water channel are in communication with an inlet end of the mixed water channel. An outlet end of the mixed water channel is in communication with the main outlet water cavity. An outlet end of the third inlet water channel is in movable communication with the main outlet water cavity. The faucet spout is mounted to the faucet body. The faucet spout has a nozzle. The nozzle is in communication with the main outlet water cavity. The mechanical control unit includes a first mechanical valve core and a second mechanical valve core that are mounted to the faucet body. The first mechanical valve core and the second mechanical valve core are configured to control opening and closing of the first inlet water channel and the second inlet water channel, respectively. The sensor control unit includes a solenoid valve core mounted to the faucet body and a sensor. The solenoid valve core controls the outlet end of the third inlet water channel to be in communication with the main outlet water cavity or not. The sensor is configured to sense a manual operation. The water flow sensor is mounted to the faucet body. The water flow sensor is configured to detect whether there is water flowing through the mixed water channel. The controller is electrically connected to the solenoid valve core, the sensor and the water flow sensor, respectively. When the water flow sensor detects that there is no water flowing through the mixed water channel, the controller makes the solenoid valve core control the outlet end of the third inlet water channel to communicate with the main outlet water cavity according to a signal of the sensor. When the water flow sensor detects that there is water flowing through the mixed water channel, the controller makes the sensor inactive and controls the outlet end of the third inlet water channel not to communicate with the main outlet water cavity through the solenoid valve core.

Preferably, the faucet body includes a first valve seat, a second valve seat and a water control seat. The water control seat is provided with the first inlet water channel, the second inlet water channel, the third inlet water channel, the mixed water channel and the main outlet water cavity. A bottom of the first valve seat has a first inlet communicating with its inner cavity. A bottom of the second valve seat has a second inlet communicating with its inner cavity. The first valve seat and the second valve seat are connected to left and right sides of the water control seat, respectively. The inner cavity of the first valve seat is in communication with an inlet end of the first inlet water channel. The inner cavity of the second valve seat is in communication with an inlet end of the second inlet water channel. The first mechanical valve core and the second mechanical valve core are mounted in the inner cavity of the first valve seat and the inner cavity of the second valve seat, respectively.

Preferably, the water control seat has a sensing water cavity. The sensing water cavity is in communication with the outlet end of the third inlet water channel. The sensing water cavity has a sensing outlet communicating with the main outlet water cavity. The solenoid valve core is mounted to the water control seat. The solenoid valve core has a valve head extending into the sensing water cavity. The valve head movably blocks the sensing outlet.

Preferably, the first inlet water channel and the third inlet water channel are arranged side by side. The first valve seat has a first valve seat connecting port and a first valve seat joining port that are in communication with the inner cavity of the first valve seat. The first valve seat connecting port and the first valve seat joining port are arranged side by side. The first valve seat connecting port and the first valve seat joining port are plugged and fitted with the inlet ends of the first inlet water channel and the third inlet water channel, respectively.

Preferably, the water control seat further has a fourth inlet water channel. An outlet end of the fourth water inlet channel is in communication with the sensing water cavity.

Preferably, the second inlet water channel and the fourth inlet water channel are arranged side by side. The second valve seat has a second valve seat connecting port and a second valve seat joining port that are in communication with the inner cavity of the second valve seat. The second valve seat connecting port and the second valve seat joining port are arranged side by side. The second valve seat connecting port and the second valve seat joining port are plugged and fitted with the inlet ends of the second inlet water channel and the fourth inlet water channel, respectively.

Preferably, the faucet body further includes a retaining seat. The retaining seat includes two retaining sleeves and a retaining plate connected to the two retaining sleeves. The two retaining sleeves of the retaining seat are fitted onto the first valve seat and the second valve seat, respectively. The retaining plate of the retaining seat supports the water control seat.

Preferably, valve stems of the first mechanical valve core and the second mechanical valve core are connected to a first handle and a second handle, respectively. A misoperation prevention unit is provided between the second mechanical valve core and the second handle.

Preferably, the misoperation prevention unit includes a stopper, a return spring, and a press member. A valve housing of the second mechanical valve core is formed with a mounting hole. The second handle has an annular wall surrounding the second mechanical valve core. The annular wall is provided with a stopper hole. An inner end of the stopper is movably inserted into the mounting hole. An outer end of the stopper is movably inserted into the stopper hole. The return spring is received in the mounting hole and abuts against the inner end of the stopper. The press member is movably fitted to the second handle. The press member movably presses the outer end of the stopper.

Preferably, the water control seat includes a front seat and a rear seat connected to the front seat. The main outlet water cavity is formed between the front seat and the rear seat. The front seat has the first inlet water channel, the second inlet water channel and the third inlet water channel that extend laterally. A rear side of the front seat is provided with a first connecting joint and a second connecting joint that are in communication with the outlet ends of the first inlet water channel and the second inlet water channel, respectively. The rear seat has a water passage and the mixed water channel that extend laterally. An outlet end of the water passage is in communication with the inlet end of the mixed water channel A front side of the rear seat has a first connecting opening and a second connecting opening that are in communication with the inlet end of the water passage and the inlet end of the mixed water channel, respectively. The first connecting opening and the second connecting opening are connected to the first connecting joint and the second connecting joint, respectively. The rear seat further has a mechanical outlet communicating with the outlet end of the mixed water channel and the main outlet water cavity. Left and right sides of the rear seat has a first core-pulling hole and a second core-pulling hole, respectively. The first core-pulling hole and the second core-pulling hole are in communication with the water passage and the mixed water channel, respectively. The water control seat further has a first plug and a second plug configured to block the first core-pulling hole and the second core-pulling hole, respectively.

Preferably, the water flow sensor includes a magnetic impeller rotatably fitted in the mixed water channel and a Hall element mounted outside the mixed water channel. The Hall element is electrically connected to the controller.

Preferably, the sensor is fitted to the nozzle. The sensor has two sensor probes. A sensing direction of one of the sensor probes is along a water spray direction of the nozzle, and a sensing direction of the other sensor probe is along a side of the nozzle.

With the foregoing solutions, when in use, the user may operate the faucet manually to control the opening and closing of the first inlet water channel and the second inlet water channel through the first mechanical valve core and the second mechanical valve core, and further to control whether water flows through the mixed water channel and the main outlet water cavity or not, so as to control the opening and closing of the nozzle of the faucet spout. In this way, the present invention realizes a mechanical control mode. In the present invention, when there is water flowing through the mixed water channel, the water flow sensor will send a signal to the controller. The controller makes the sensor inactive and controls the outlet end of the third inlet water channel not to communicate with the main outlet water cavity through the solenoid valve core, so as to prevent the sensor from interfering with the mechanical control mode of the present invention. In the present invention, when the first mechanical valve core and the second mechanical valve core are closed to stop water flowing through the first inlet water channel and the second inlet water channel, there is no water flowing through the mixed water channel. The water flow sensor detects that there is no water flowing through the mixed water channel. The controller receives the signal of the sensor for the solenoid valve core to control the outlet end of the third inlet water channel to communicate with the main outlet water cavity according to the signal of the sensor, so as to control the opening and closing of the nozzle of the faucet spout. In this way, the present invention realizes a sensor control mode.

It can be seen from the above that the present invention has a manual control mode and a sensor control mode, which is convenient for the user to use the faucet. Moreover, the priority of the manual control mode of the present invention is higher than that of the sensor control mode. In this way, when the sensor control mode of the faucet is abnormal, the faucet can be operated manually to control the first mechanical valve core and the second mechanical valve core for the nozzle to spray water out, thereby ensuring the user's demand for water.

DETAILED DESCRIPTION OF THE PREFERRED EMBODIMENTS

Embodiments of the present invention will now be described, by way of example only, with reference to the accompanying drawings.

Figure 1:
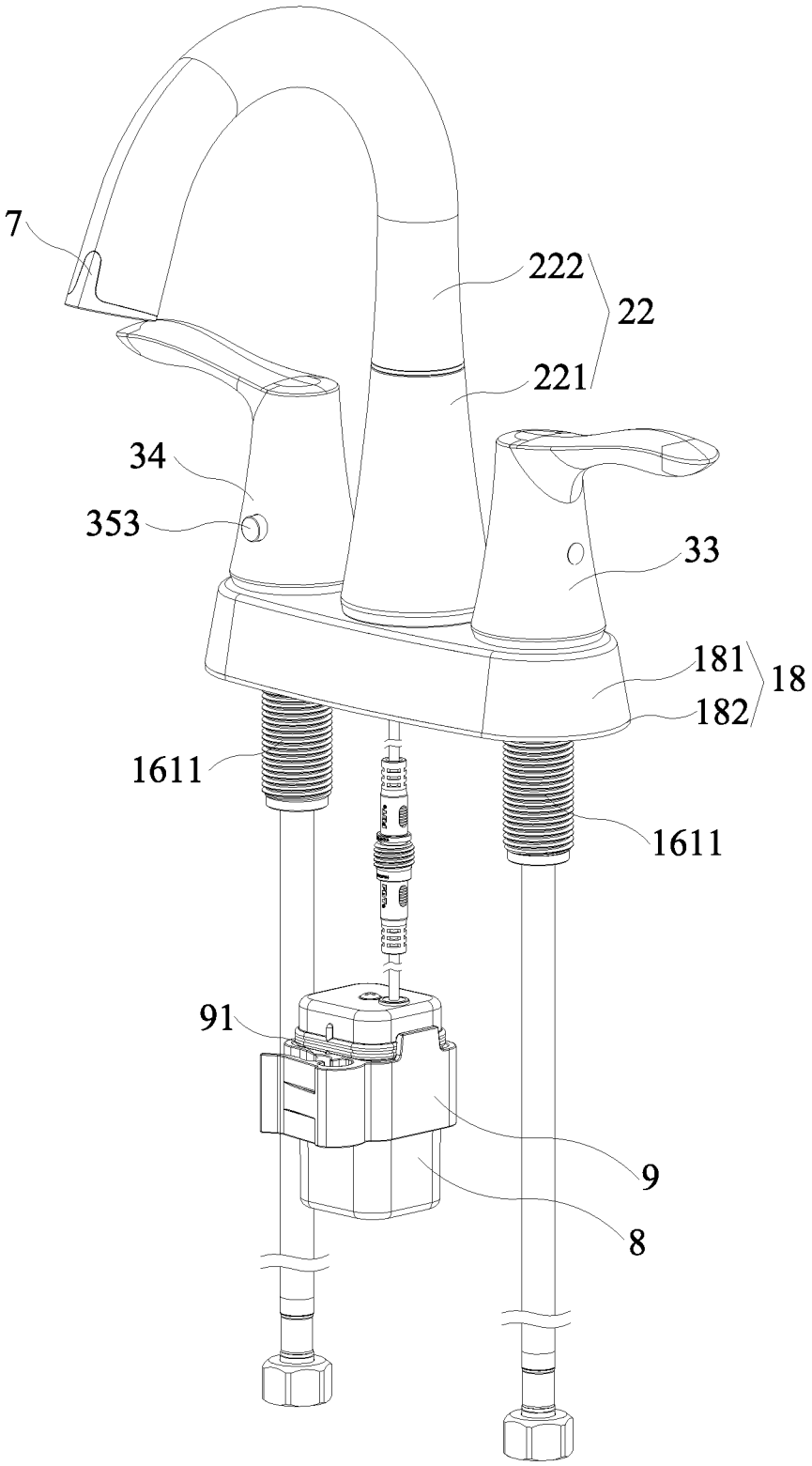
FIG. 1 is a first perspective view of the present invention.
Figure 2:
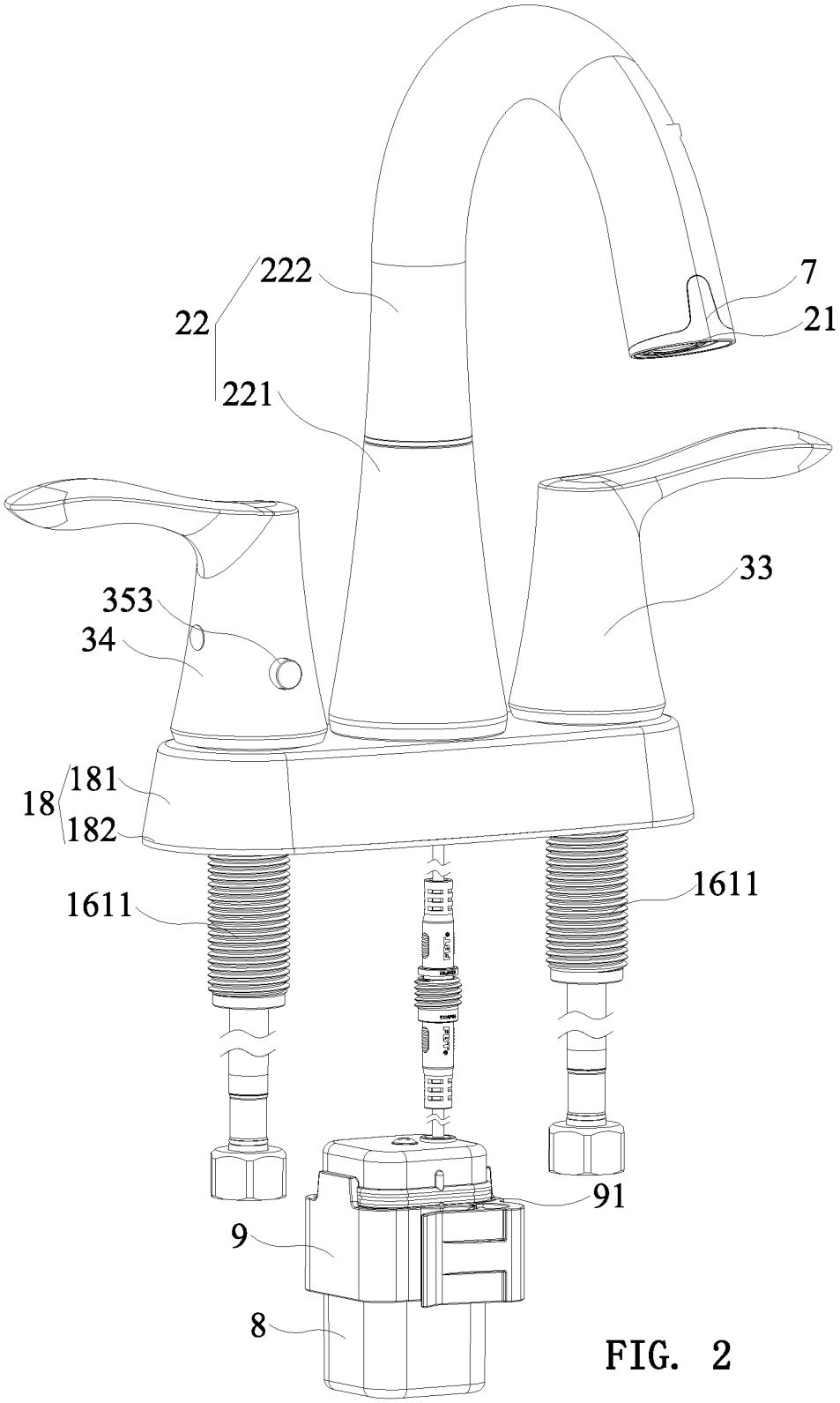
FIG. 2 is a second perspective view of the present invention.
Figure 3:
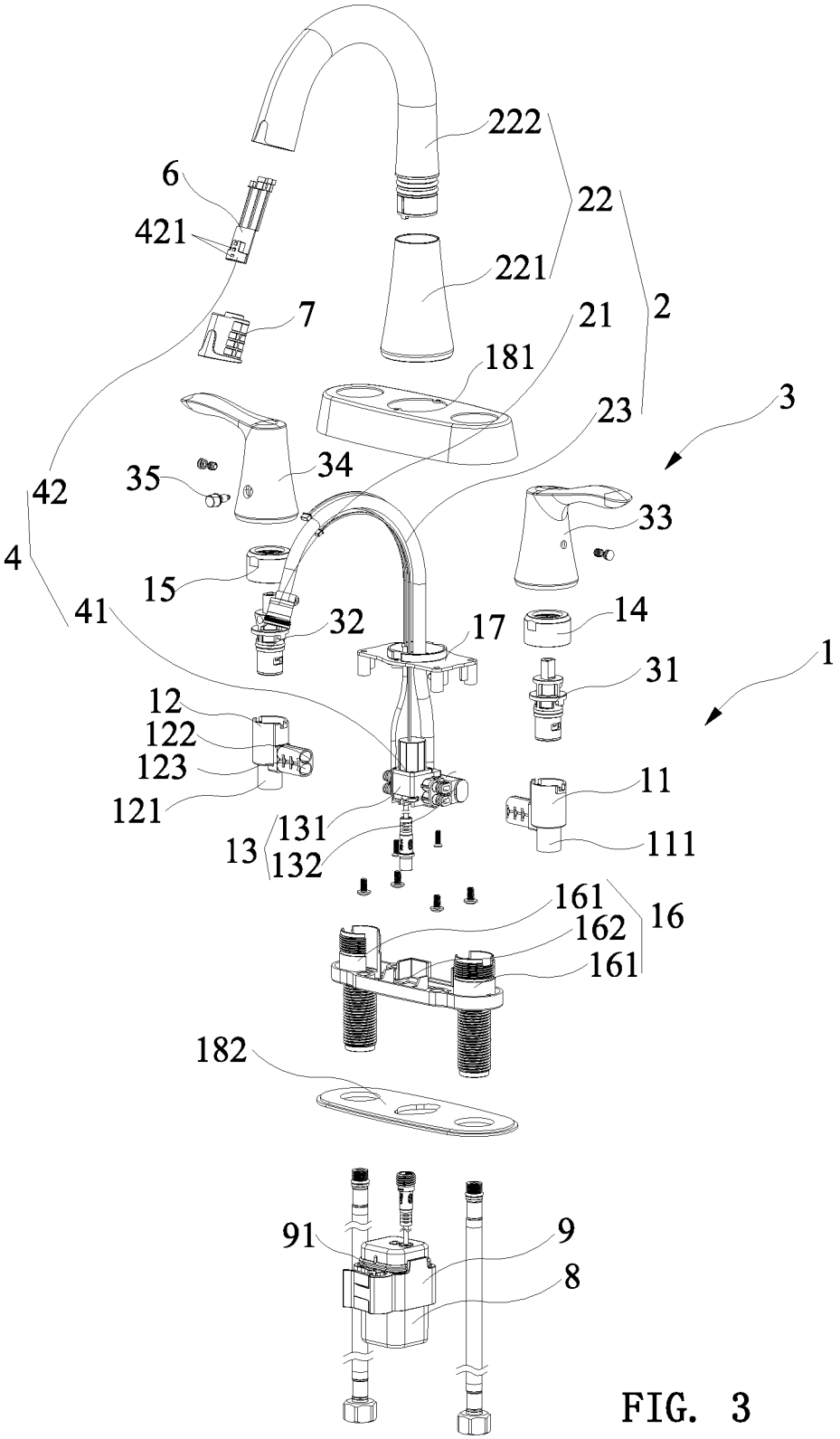
FIG. 3 is a first exploded view of the present invention.
Figure 4:
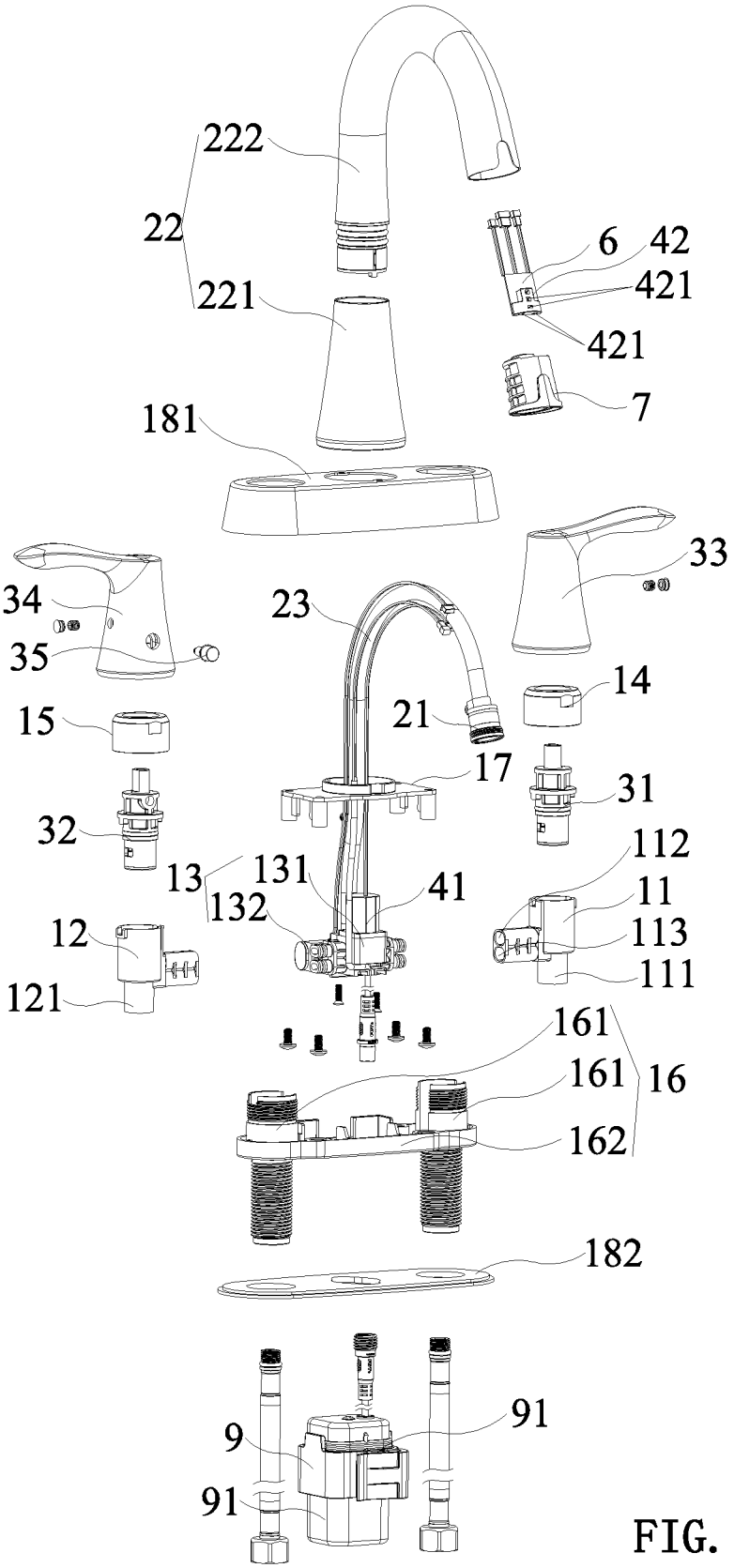
FIG. 4 is a second exploded view of the present invention.
Figure 5:
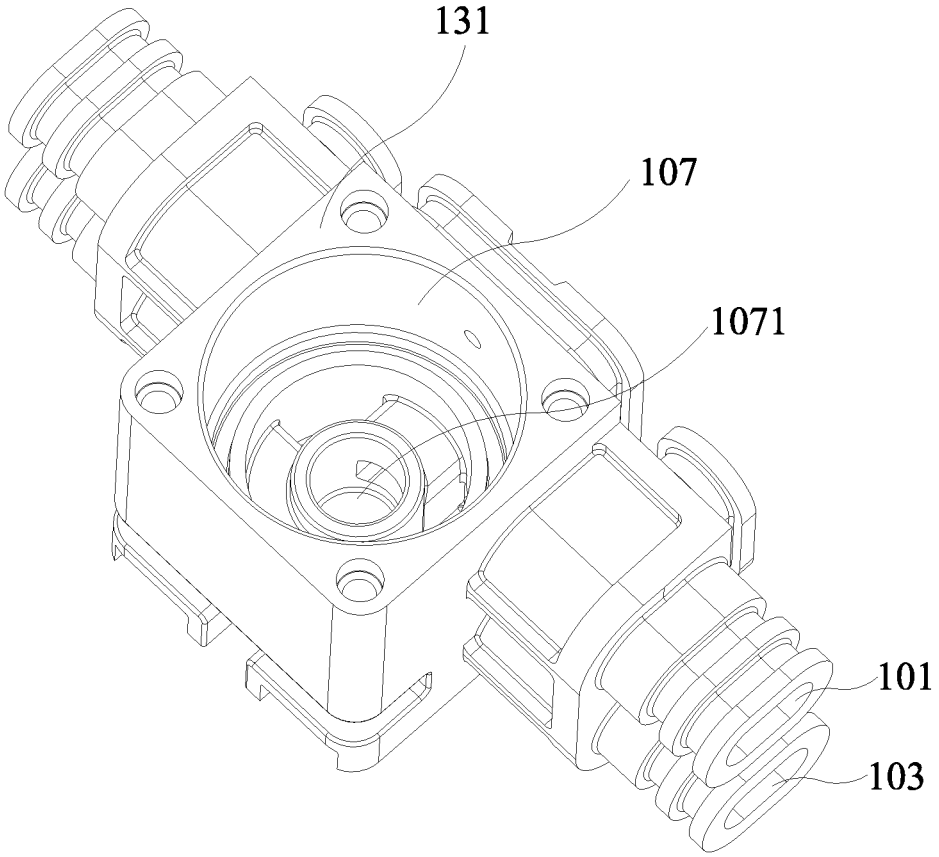
FIG. 5 is a first perspective view of the front seat of the present invention.
Figure 6:
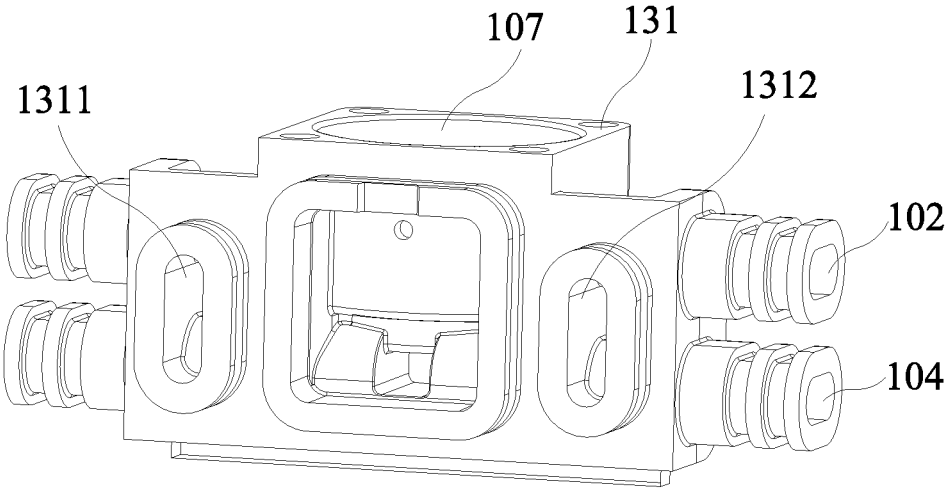
FIG. 6 is a second perspective view of the front seat of the present invention.
Figure 7:
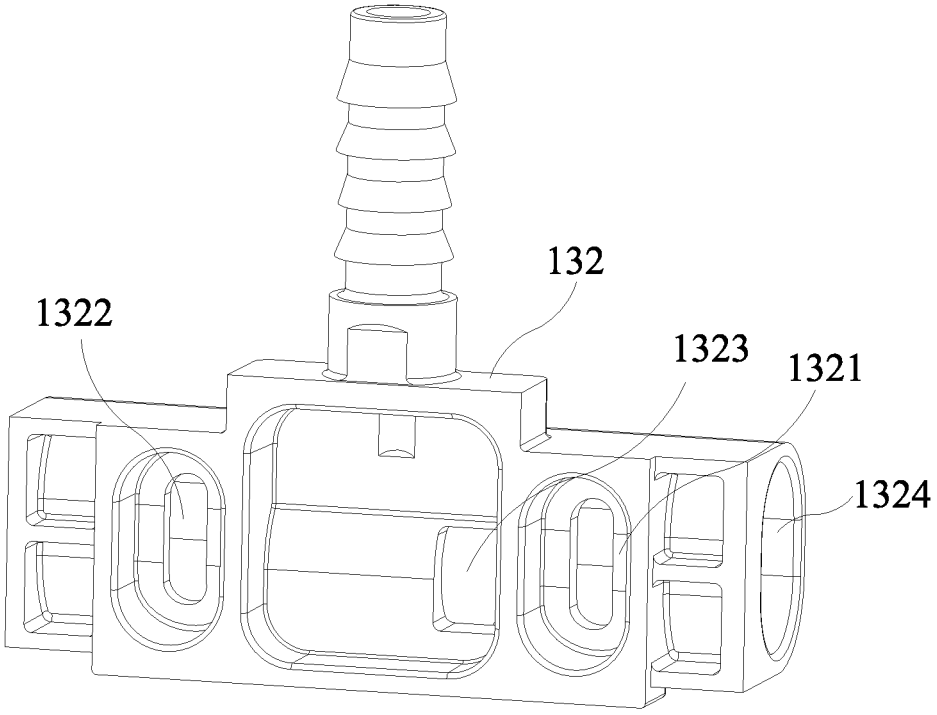
FIG. 7 is a first perspective view of the rear seat of the present invention.
Figure 8:
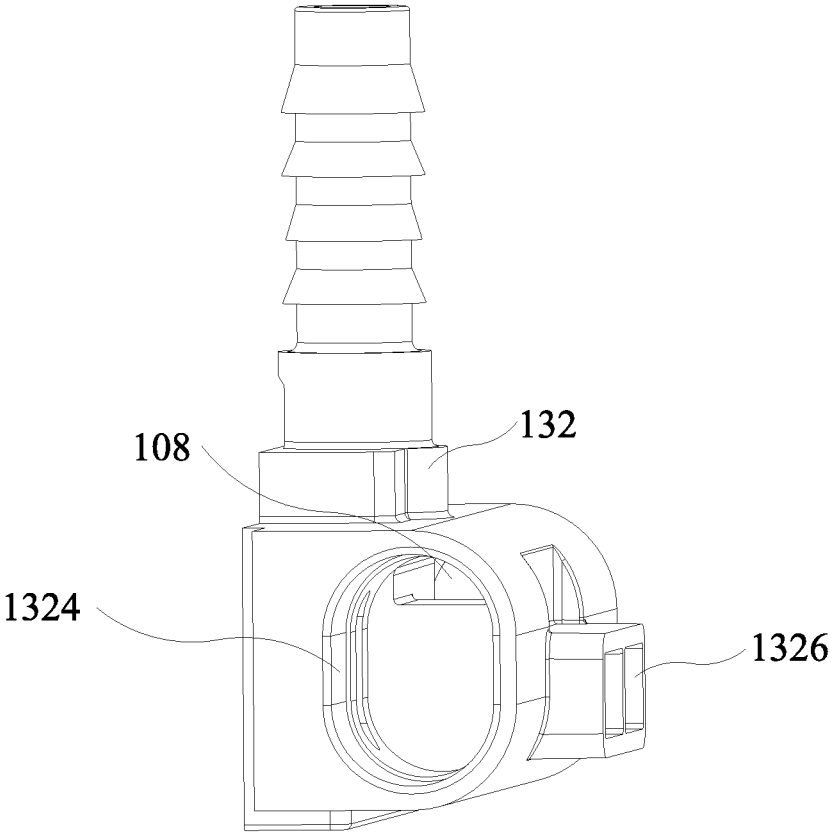
FIG. 8 is a second perspective view of the rear seat of the present invention.
Figure 9:
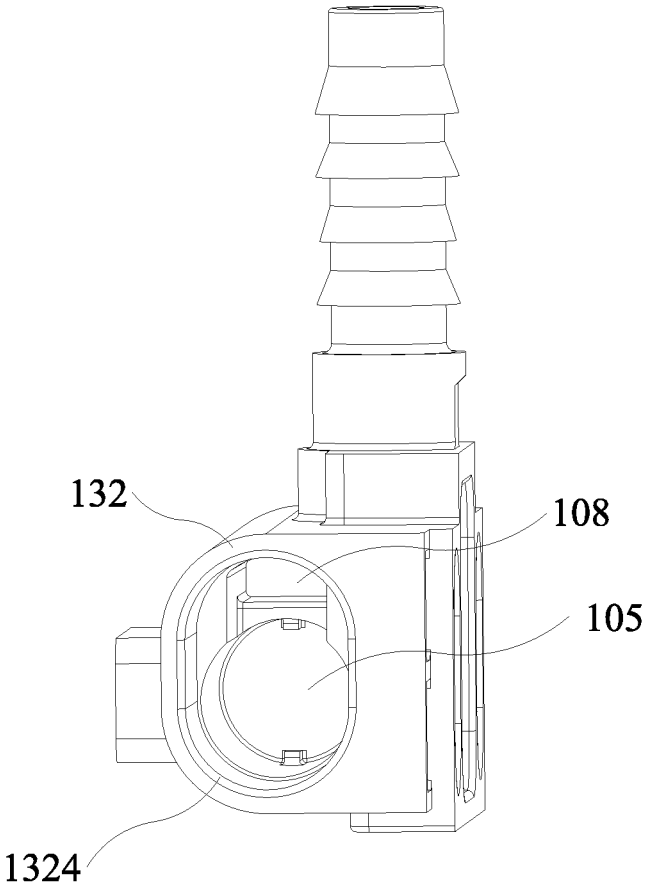
FIG. 9 is a third perspective view of the rear seat of the present invention.
Figure 10:
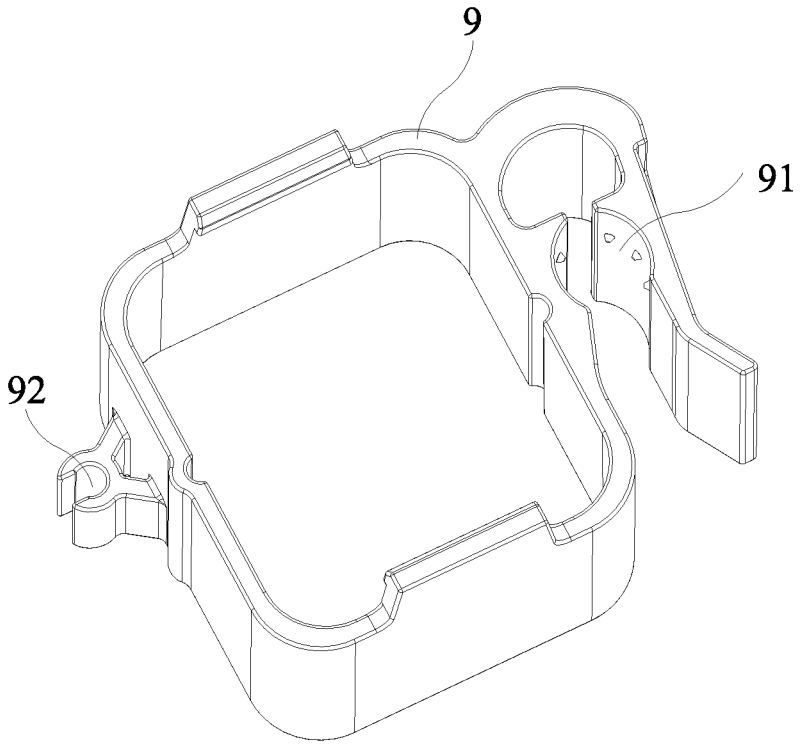
FIG. 10 is a perspective view of the battery holder of the present invention.
Figure 11:
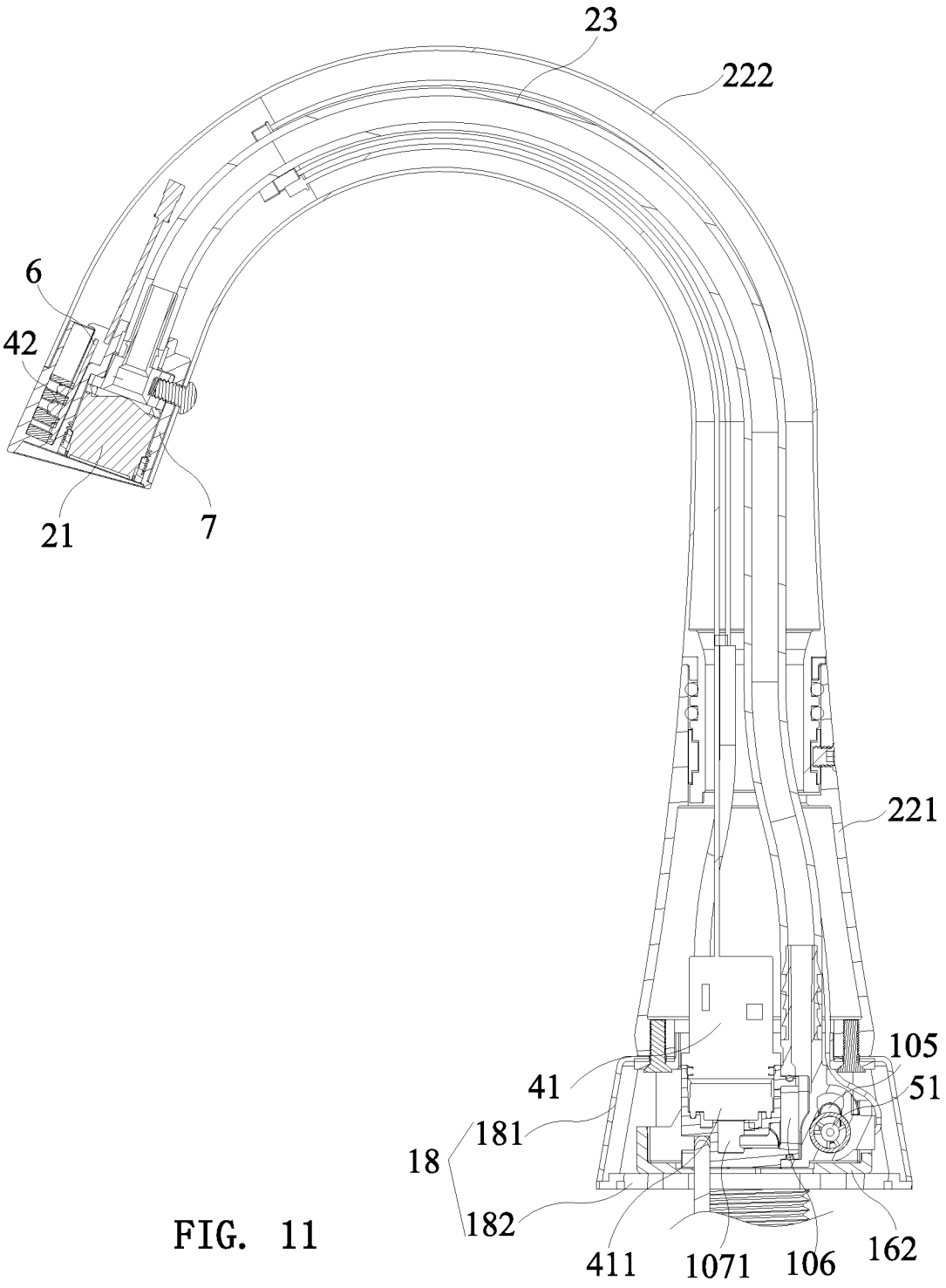
FIG. 11 is a first cross-sectional view of the present invention.
Figure 12:
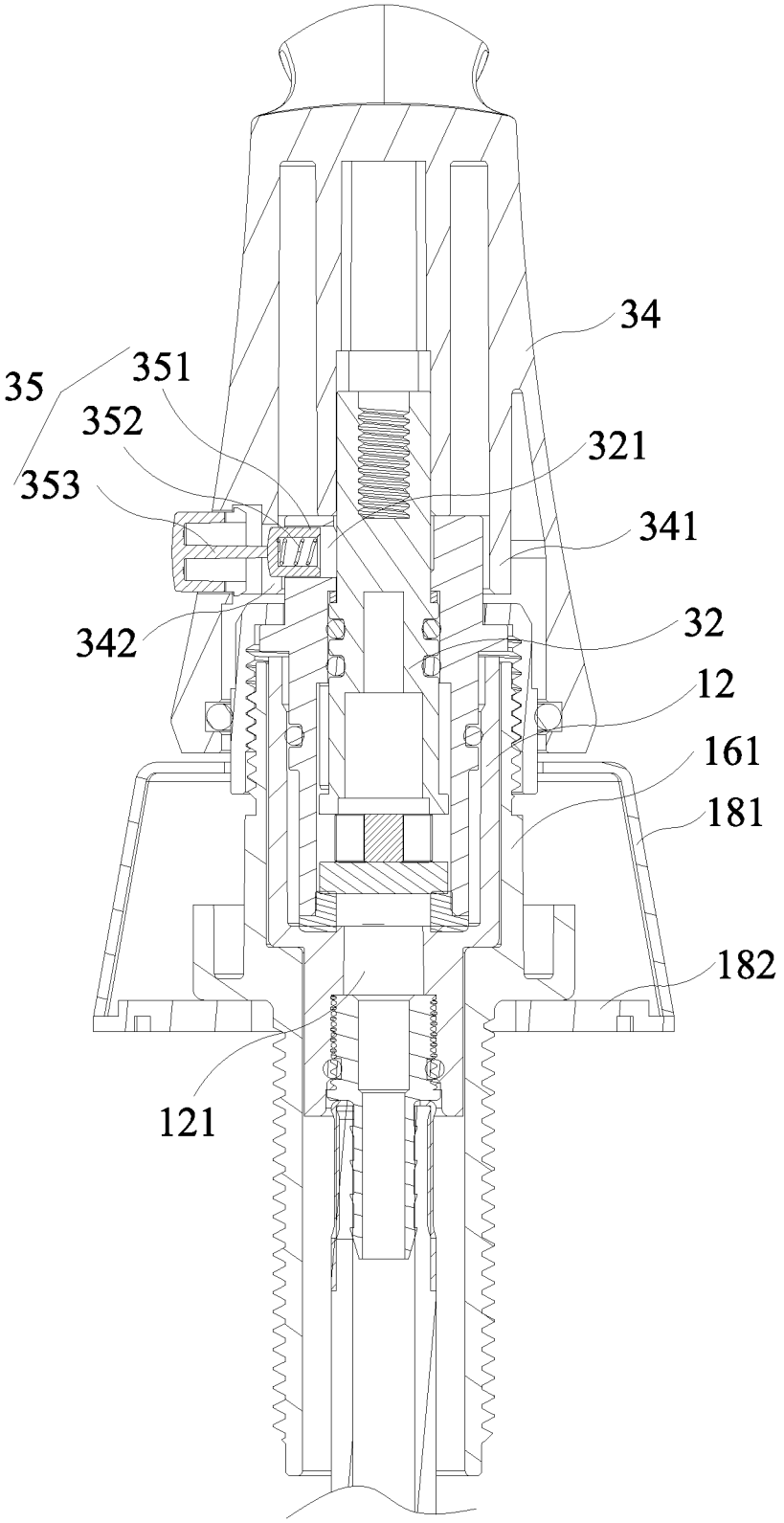
FIG. 12 is a second cross-sectional view of the present invention.
Figure 13:
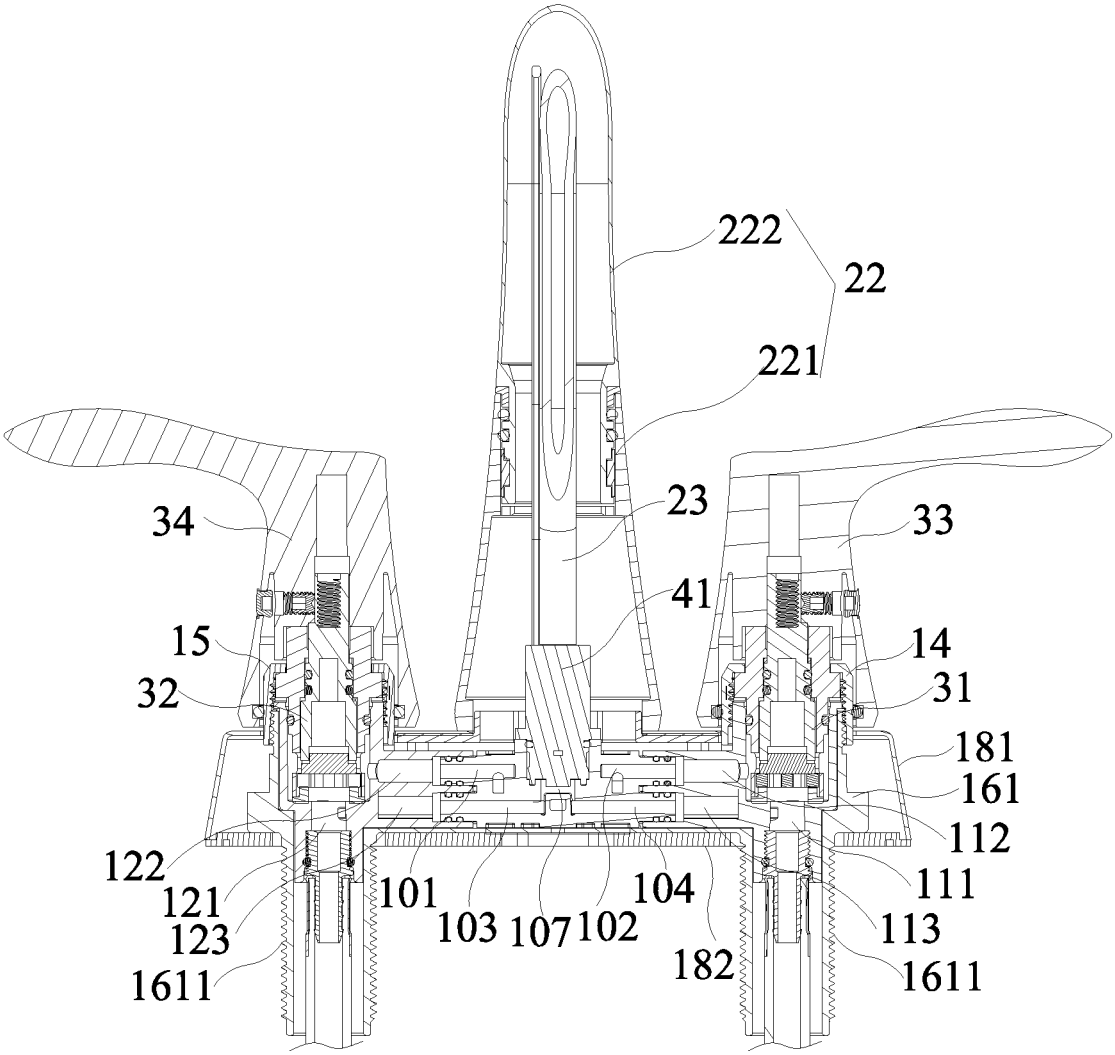
FIG. 13 is a third cross-sectional view of the present invention.
Figure 14:
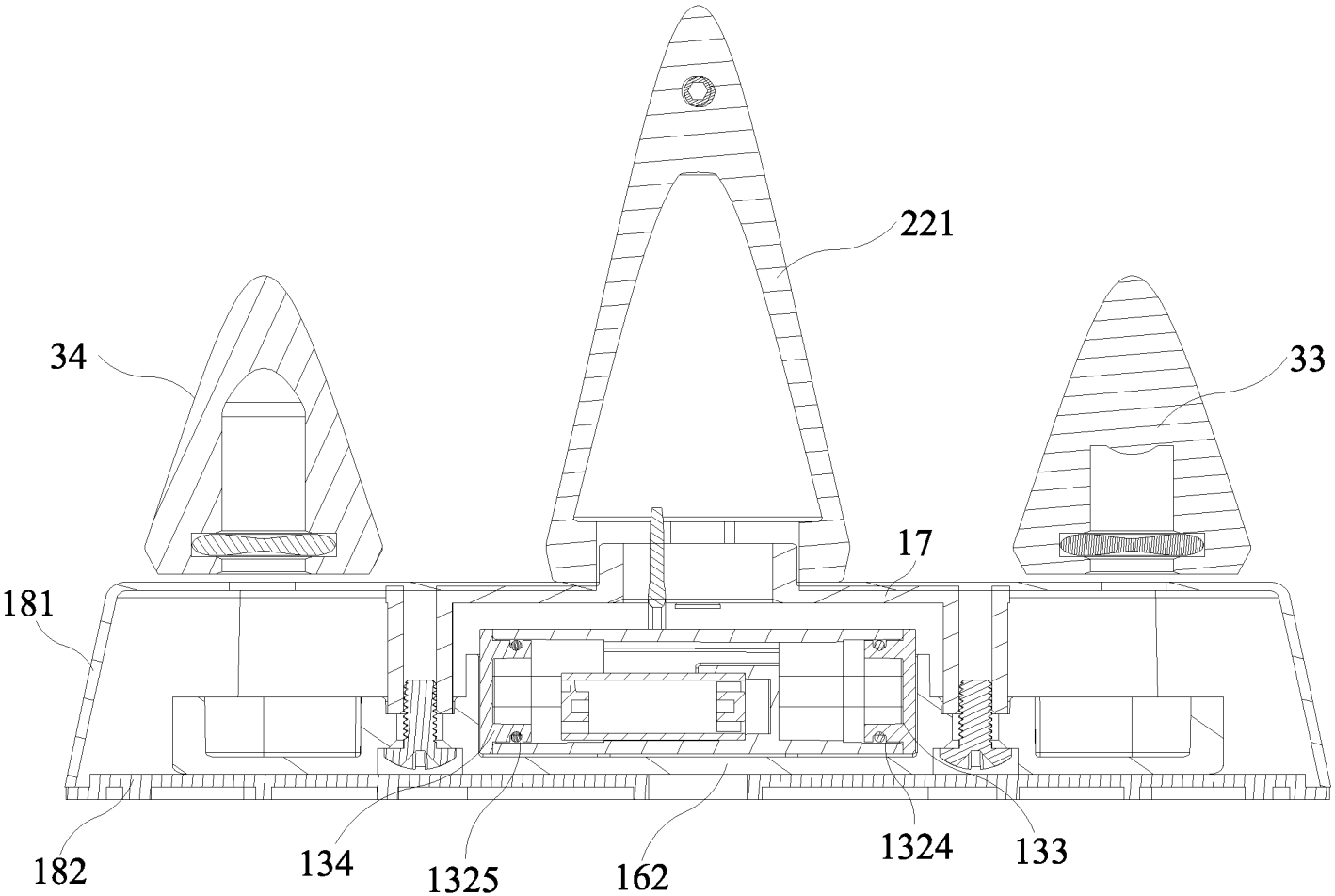
FIG. 14 is a fourth cross-sectional view of the present invention.
Figure 15:
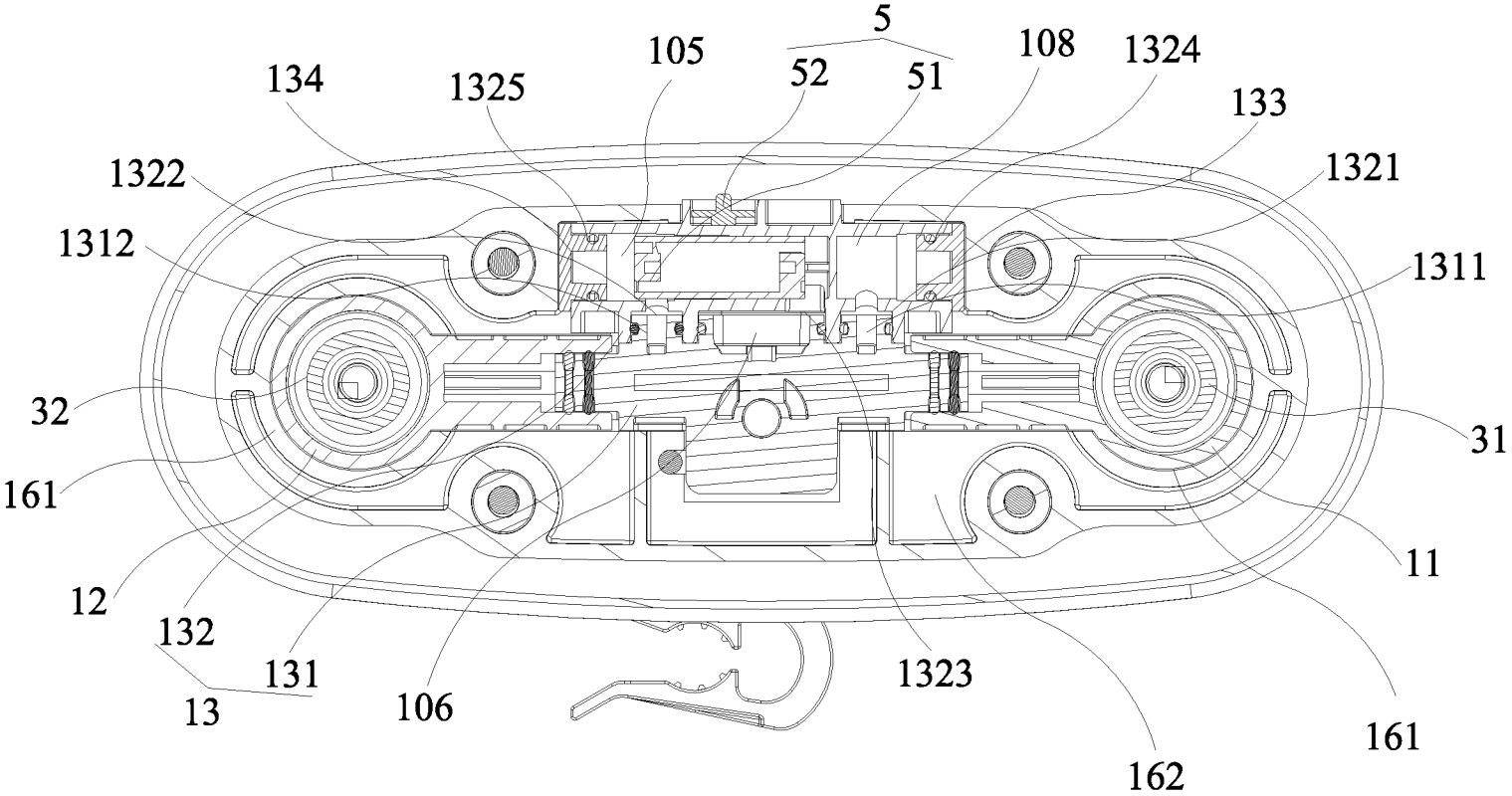
FIG. 15 is a fifth cross-sectional view of the present invention.

As shown in FIG. 1 through FIG. 8, the present invention discloses a dual-handle and dual-control faucet, comprising a faucet body 1, a faucet spout 2, a mechanical control unit 3, a sensor control unit 4, a water flow sensor 5, and a controller 6. The faucet body 1 has a first inlet water channel 101, a second inlet water channel 102, a third inlet water channel 103, a mixed water channel 105, and a main outlet water cavity 106. An outlet end of the first inlet water channel 101 and an outlet end of the second inlet water channel 102 are in communication with an inlet end of the mixed water channel 105. An outlet end of the mixed water channel 105 is in communication with the main outlet water cavity 106. An outlet end of the third inlet water channel 103 is in movable communication with the main outlet water cavity 106. The faucet spout 2 is mounted to the faucet body 1. The faucet spout 2 has a nozzle 21. The nozzle 21 is in communication with the main outlet water cavity 106. The mechanical control unit 3 includes a first mechanical valve core 31 and a second mechanical valve core 32 that are mounted to the faucet body 1. The first mechanical valve core 31 and the second mechanical valve core 32 are configured to control opening and closing of the first inlet water channel 101 and the second inlet water channel 102, respectively. The sensor control unit 4 includes a solenoid valve core 41 mounted to the faucet body 1 and a sensor 42. The solenoid valve core 41 controls the outlet end of the third inlet water channel 103 to be in communication with the main outlet water cavity 106 or not. The sensor 42 is configured to sense a manual operation. The water flow sensor 5 is mounted to the faucet body 1. The water flow sensor 5 is configured to detect whether there is water flowing through the mixed water channel 105. The controller 6 is electrically connected to the solenoid valve core 41, the sensor 42 and the water flow sensor 5, respectively.

In the present invention, when the water flow sensor 5 detects that there is no water flowing through the mixed water channel 105, the controller 6 makes the solenoid valve core 41 control the outlet end of the third inlet water channel 103 to communicate with the main outlet water cavity 106 according to a signal of the sensor 42. In the present invention, when the water flow sensor 5 detects that there is water flowing through the mixed water channel 105, the controller 6 makes the sensor 42 inactive and controls the outlet end of the third inlet water channel 103 not to communicate with the main outlet water cavity 106 through the solenoid valve core 41. When the sensor 42 is inactive, the solenoid valve core 41 will not control the outlet end of the third inlet water channel 103 to communicate with the main outlet water cavity 106 according to the signal of the sensor 42.

When in use, the user may operate the faucet manually to control the opening and closing of the first inlet water channel 101 and the second inlet water channel 102 through the first mechanical valve core 31 and the second mechanical valve core 32, and further to control whether water flows through the mixed water channel 105 and the main outlet water cavity 106 or not, so as to control the opening and closing of the nozzle 21 of the faucet spout 2. In this way, the present invention realizes a mechanical control mode. In the present invention, when there is water flowing through the mixed water channel 105, the water flow sensor 5 will send a signal to the controller 6. The controller 6 makes the sensor 42 inactive and controls the outlet end of the third inlet water channel 103 not to communicate with the main outlet water cavity 106 through the solenoid valve core 41, so as to prevent the sensor 42 from interfering with the mechanical control mode of the present invention. In the present invention, when the first mechanical valve core 31 and the second mechanical valve core 32 are closed to stop water flowing through the first inlet water channel 101 and the second inlet water channel 102, there is no water flowing through the mixed water channel 105. The water flow sensor 5 detects that there is no water flowing through the mixed water channel 105. The controller 6 receives the signal of the sensor 42 for the solenoid valve core 41 to control the outlet end of the third inlet water channel 103 to communicate with the main outlet water cavity 106 according to the signal of the sensor 42, so as to control the opening and closing of the nozzle 21 of the faucet spout 2. In this way, the present invention realizes a sensor control mode.

It can be seen from the above that the present invention has a manual control mode and a sensor control mode, which is convenient for the user to use the faucet. Moreover, the priority of the manual control mode of the present invention is higher than that of the sensor control mode. In this way, when the sensor control mode of the faucet is abnormal, the faucet can be operated manually to control the first mechanical valve core 31 and the second mechanical valve core 32 for the nozzle 21 to spray water out, thereby ensuring the user's demand for water.

In the present invention, the faucet body 1 may include a first valve seat 11, a second valve seat 12 and a water control seat 13. The water control seat 13 is provided with the first inlet water channel 101, the second inlet water channel 102, the third inlet water channel 103, the mixed water channel 105 and the main outlet water cavity 106. The first valve seat 11 and the second valve seat 12 are connected to the left and right sides of the water control seat 13, respectively. The bottom of the first valve seat 11 has a first inlet 111 communicating with its inner cavity. The bottom of the second valve seat 12 has a second inlet 121 communicating with its inner cavity. The first inlet 111 and the second inlet 121 are configured to introduce external water sources (cold water and hot water) into the faucet. The first valve seat 11 has a first valve seat connecting port 112 connected to an inlet end of the first inlet water channel 101. The first valve seat connecting port 112 communicates with the inner cavity of the first valve seat 11 so that the inner cavity of the first valve seat 11 communicates with the inlet end of the first inlet water channel 101. The second valve seat 12 has a second valve seat connecting port 122 connected to an inlet end of the second inlet water channel 102. The second valve seat connecting port 122 communicates with the inner cavity of the second valve seat 12 so that the inner cavity of the second valve seat 12 communicates with the inlet end of the second inlet water channel 102. The first mechanical valve core 31 and the second mechanical valve core 32 are mounted in the inner cavity of the first valve seat 11 and the inner cavity of the second valve seat 12, respectively. The first mechanical valve core 31 is mounted to the first valve seat 11 through a first valve cover 14. The first mechanical valve core 31 is inserted into the inner cavity of the first valve seat 11. The first valve cover 14 is connected to the first valve seat 11 and presses the valve housing of the first mechanical valve core 31. The second mechanical valve core 32 is mounted to the second valve seat 12 through a second valve cover 15. The second mechanical valve core 32 is inserted into the inner cavity of the second valve seat 12. The second valve cover 15 is connected to the second valve seat 12 and presses the valve housing of the second mechanical valve core 32.

In the present invention, the valve stems of the first mechanical valve core 31 and the second mechanical valve core 32 are connected to a first handle 33 and a second handle 34 respectively, so that the first mechanical valve core 31 and the second mechanical valve core 32 can be operated conveniently. A misoperation prevention unit 35 is provided between the second mechanical valve core 32 and the second handle 34. The second inlet 121 of the second valve seat 12 is configured to introduce hot water into the faucet. The second mechanical valve core 32 is configured to control hot water to be delivered to the second inlet water channel 102. The present invention can prevent the second mechanical valve core 32 from being opened by mistake through the misoperation prevention unit 35 disposed between the second mechanical valve core 32 and the second handle 34. Thus, it is able to prevent hot water from flowing to the second inlet water channel 102 to flow out from the nozzle 21 by mistake. This improves the safety of the present invention. Specifically, the misoperation prevention unit 35 includes a stopper 351, a return spring 352, and a press member 353. The valve housing of the second mechanical valve core 32 is formed with a mounting hole 321. The second handle 34 has an annular wall 341 surrounding the second mechanical valve core 32. The annular wall 341 is provided with a stopper hole 342. The inner end of the stopper 351 is movably inserted into the mounting hole 321, and the outer end of the stopper 351 is movably inserted into the stopper hole 342. The return spring 352 is received in the mounting hole 321 and abuts against the inner end of the stopper 351. The press member 353 is movably fitted to the second handle 34. The press member 353 movably presses the outer end of the stopper 351. When the misoperation prevention unit 35 is in a normal state, the inner and outer ends of the stopper 351 are inserted into the mounting hole 321 and the stopper hole 342, respectively. At this time, the second handle 34 is fixedly fitted with the valve housing of the second mechanical valve core 32 so that the second handle 34 cannot drive the valve stein of the second mechanical valve core 32 to rotate. In this way, the second mechanical core 32 cannot be opened, so as to prevent the second mechanical core 32 from being opened by mistake. When the second mechanical valve core 32 needs to be opened, the user presses the press member 353 for the press member 353 to press the outer end of the stopper 351, thereby driving the outer end of the stopper 351 to move out of the stopper hole 342. At this time, turning the second handle 34 will cause the valve stein of the second mechanical valve core 32 to rotate along with the rotation of the second handle 34, so that the second mechanical valve core 32 can be opened. In the present invention, a misoperation prevention unit may be provided between the first mechanical valve core 31 and the first handle 33, so as to prevent the first mechanical valve core 31 from being opened by mistake.

In the present invention, the water control seat 13 has a sensing water cavity 107. The sensing water cavity 107 is in communication with the outlet end of the third inlet water channel 103. The sensing water cavity 107 has a sensing outlet 1071 communicating with the main outlet water cavity 106. The solenoid valve core 41 is mounted to the water control seat 13. The solenoid valve core 41 has a valve head 411 extending into the sensing water cavity 107. The valve head 411 movably blocks the sensing outlet 1071. When the valve head 411 blocks the sensing outlet 1071, the outlet end of the third inlet water channel 103 is not in communication with the main outlet water cavity 106. When the valve head 411 opens the sensing outlet 1071, the outlet end of the third inlet water channel 103 is in communication with the main outlet water cavity 106. The solenoid valve core 41 may be fixed to the upper end of the water control seat 13, so as to reduce the space occupied by the solenoid valve core 41 in the front, rear, left, and right directions.

In the present invention, the water control seat 13 may further have a fourth inlet water channel 104. An outlet end of the fourth water inlet channel 104 is in communication with the sensing water cavity 107. The third inlet water channel 103 and the fourth inlet water channel 105 are configured to introduce external cold and hot water into the sensing water cavity 107 for mixing cold and hot water. In this way, when the valve head 411 opens the sensing outlet 1071, the mixed water flows out from the nozzle 21 of the faucet spout 2. The faucet provided by the present invention is able to spray out the mixed water in the sensor control mode. The first valve seat 11 may have a first valve seat joining port 113 connected to the inlet end of the third inlet water channel 103. The first valve seat joining port 113 communicates with the inner cavity of the first valve seat 11, so that the inlet end of the third inlet water channel 103 communicates with the inner cavity of the first valve seat 11. In this way, the water flows of the first inlet water channel 101 and the third inlet water channel 103 come from the water source introduced by the first inlet 111 of the first valve seat 11, thereby simplifying the structure of the present invention. Similarly, the second valve seat 12 may have a second valve seat joining port 123 connected to the inlet end of the fourth inlet water channel 104. The second valve seat joining port 123 communicates with the inner cavity of the second valve seat 12, so that the inlet end of the fourth inlet water channel 104 communicates with the inner cavity of the second valve seat 12. In this way, the water flows of the second inlet water channel 102 and the fourth inlet water channel 104 come from the water source introduced by the second inlet 121 of the second valve seat 12, thereby simplifying the structure of the present invention. In addition, the first inlet water channel 101 and the third inlet water channel 103 are arranged side by side. The first valve seat connecting port 112 and the first valve seat joining port 113 are arranged side by side. The first valve seat connecting port 112 and the first valve seat joining port 113 are plugged and fitted with the inlet ends of the first inlet water channel 101 and the third inlet water channel 103, respectively. In this way, the first valve seat connecting port 112 and the first valve seat joining port 113 are connected to the inlet ends of the first inlet water channel 101 and the third inlet water channel 103 synchronously, so as to facilitate the connection between the first valve seat 11 and the water control seat 13. Similarly, the second inlet water channel 102 and the fourth inlet water channel 104 are arranged side by side. The second valve seat connecting port 122 and the second valve seat joining port 123 are arranged side by side. The second valve seat connecting port 122 and the second valve seat joining port 123 are plugged and fitted with the inlet ends of the second inlet water channel 102 and the fourth inlet water channel 104, respectively. In this way, the second valve seat connecting port 122 and the second valve seat joining port 123 are connected to the inlet ends of the second inlet water channel 102 and the fourth inlet water channel 104, synchronously, so as to facilitate the connection between the second valve seat 12 and the water control seat 13.

In the present invention, the water control seat 13 may include a front seat 131 and a rear seat 132 connected to the front seat 131, so as to form a water channel and a cavity inside the water control seat 13. The main outlet water cavity 106 is formed between the front seat 131 and the rear seat 132. The front seat 131 has the first inlet water channel 101, the second inlet water channel 102, the third inlet water channel 103 and the fourth inlet water channel 104 that extend laterally. The first inlet water channel 101 and the third inlet water channel 103 are located on the left side of the front seat 131. The second inlet water channel 102 and the fourth inlet water channel 104 are located on the right side of the front seat 131. The front seat 131 further has the sensing water cavity 107. The sensing water cavity 107 is located in the middle of the front seat 131. The rear side of the front seat 131 is provided with a first connecting joint 1311 and a second connecting joint 1312 that communicate with the outlet ends of the first inlet water channel 101 and the second inlet water channel 102, respectively. The rear seat 132 has a water passage 108 and the mixed water channel 105 that extend laterally. An outlet end of the water passage 108 is in communication with the inlet end of the mixed water channel 105. The front side of the rear seat 132 has a first connecting opening 1321 and a second connecting opening 1322 that communicate with the inlet end of the water passage 108 and the inlet end of the mixed water channel 105, respectively. The first connecting opening 1321 and the second connecting opening 1322 are connected to the first connecting joint 1311 and the second connecting joint 1312, respectively, so that the outlet end of the first inlet water channel 101 is in communication with the inlet end of the mixed water channel 105 through the water passage 108, and the outlet end of the second inlet water channel 102 is in communication with the inlet end of the mixed water channel 105. The rear seat 132 further has a mechanical outlet 1323 communicating with the outlet end of the mixed water channel 105 and the main outlet water cavity 106. The left and right sides of the rear seat 132 has a first core-pulling hole 1324 and a second core-pulling hole 1325, respectively. The first core-pulling hole 1324 and the second core-pulling hole 1325 are in communication with the water passage 108 and the mixed water channel 105, respectively. The water control seat further has a first plug 133 and a second plug 134 configured to block the first core-pulling hole 1324 and the second core-pulling hole 1325, respectively. In the present invention, by providing the first core-pulling hole 1324 and the second core-pulling hole 1325, the water passage 108 and the mixed water channel 105 can be easily formed by injection molding.

In the present invention, the faucet body 1 further includes a retaining seat 16. The retaining seat 16 includes two retaining sleeves 161 and a retaining plate 162 connected to the two retaining sleeves 161. The two retaining sleeves 161 of the retaining seat 16 are fitted onto the first valve seat 11 and the second valve seat 12, respectively. The retaining plate 162 of the retaining seat 16 supports the water control seat 13. The retaining seat 16 is configured to confine the first valve seat 11, the second valve seat 12 and the water control seat 13, so that the first valve seat 11, the second valve seat 12 and the water control seat 13 are connected firmly. Each of the two retaining sleeves 161 of the retaining seat 16 is provided with an external threaded pipe section 1611, so that the retaining seat 16 can be locked to the three-hole countertop by nuts matched with the retaining sleeves 161, and then the dual-handle and dual-control faucet is installed to the three-hole countertop. The faucet body 1 further includes a cover plate 17 mounted to the retaining plate 162 of the retaining seat 16. The cover plate 17 is locked to the retaining plate 162 by screws. The water control seat 13 is clamped by the cover plate 17 and the retaining plate 162 to secure the water control seat 13 to the retaining seat 14 firmly.

In the present invention, the faucet body 1 may further include a decorative casing 18. The decorative casing 18 includes an upper casing 181 and a lower casing 182 connected to the upper casing 181. The decorative casing 18 is fitted onto the two retaining sleeves 161 of the retaining seat 16. The decorative casing 18 covers the retaining plate 162 of the retaining seat 16, the water control seat 13 and the cover plate 17. In the present invention, the decorative casing 18 is configured to hide the retaining plate 162 of the retaining seat 16, the water control seat 13 and the cover plate 17, thereby beautifying the appearance of the dual-handle and dual-control faucet of the present invention.

In the present invention, the faucet spout 2 may include an outer pipe 22, an inner pipe 23, and the nozzle 21. The inner pipe 23 is inserted into the outer pipe 22. One end of the inner pipe 23 is connected to the nozzle 21, and the other end of the inner pipe 23 is connected to the water control seat 13. The other end of the inner pipe 23 is in communication with the main outlet water cavity 106. In this way, the water flow of the main outlet water cavity 106 is delivered to the nozzle 21 through the inner pipe 23. The outer pipe 22 may include a fixed pipe 221 and a movable pipe 222. One end of the fixed pipe 221 is mounted to the faucet body 1. The movable pipe 222 is rotatably connected to the other end of the fixed pipe 221. The nozzle 21 is mounted to the other end of the movable pipe 222. In this way, the user can turn the movable pipe 222 to adjust the water spray direction of the nozzle 21. The fixed pipe 221 is inserted through the upper casing 181 and then locked to the cover plate 17 of the faucet body 1.

In the present invention, the water flow sensor 5 includes a magnetic impeller 51 rotatably fitted in the mixed water channel 105 and a Hall element 52 mounted outside the mixed water channel 105. The Hall element 52 is electrically connected to the controller 6. When water passes through the mixed water channel 105, the magnetic impeller 51 rotates to generate a changing magnetic field, so that the Hall element 52 generates a corresponding signal and outputs it to the controller 6 for the controller 6 to know that water passes through the mixed water channel 105. The Hall element 52 may be mounted outside the water control seat 13. The rear side of the rear seat 132 of the water control seat 13 may be formed with an engaging groove 1326 for mounting the Hall element 52.

In the present invention, the sensor 42 is fitted to the nozzle 21 of the faucet spout 2 to facilitate the sensor 42 to sense the presence of a user. The sensor 42 has two sensor probes 421. The sensor probe 421 may be an infrared sensor probe. The sensing direction of one sensor probe 421 is along the water spray direction of the nozzle 21, and the sensing direction of the other sensor probe 421 is along the side of the nozzle 21. In this way, the present invention can realize two sensor control modes for controlling the faucet to spray water in different manners. The sensor probe 421 with the sensing direction along the water spray direction of the nozzle 21 is used to realize the sensor control mode that when the sensor probe senses the presence of the user, the faucet is immediately turned on; when the sensor probe senses the absence of the user, the faucet is immediately turned off. The other sensor probe 421 with the sensing direction along the side of the nozzle 21 is used to realize the sensor control mode that when the sensor probe senses the presence of the user, the faucet sprays water continuously; when the sensor probe senses the presence of the user once again, the faucet stops spraying water. It should be noted that the sensor 42 is not limited to be mounted to the nozzle 21. The sensor 42 may be mounted to other parts of the faucet body 1 or the faucet spout 2 as long as the sensor 42 is able to sense the presence of the user. In addition, the number of sensor probes 421 of the sensor 42 is not limited to two. The number of sensor probes 421 of the sensor 42 is at least one.

In the present invention, the controller 6 and the sensor 42 may be mounted together on a mounting bushing 7. The mounting bushing 7 and the nozzle 21 are locked to the movable pipe 222 by screws.

The present invention further includes a power supply battery 8. The power supply battery 8 is electrically connected to the controller 6 for supplying power to the controller 6. The power supply battery 8 is mounted to a battery holder 9. The battery holder 9 includes an elastic clamp 91. The elastic clamp 91 is configured to clamp an inlet water pipe connected to the first valve seat 11 or the second valve seat 12 to secure the battery holder 9. In this way, the battery holder 9 with the elastic clamp 91 can position the power supply battery 8 easily. The battery holder 9 may be formed with a slot 92 for insertion of a screwdriver. In this way, the dual-handle and dual-control faucet of the present invention may be equipped with a screwdriver on the battery holder 9, so that the user can repair the dual-handle and dual-control faucet of the present invention.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A dual-handle and dual-control faucet, comprising a faucet body, a faucet spout, a mechanical control unit, a sensor control unit, a water flow sensor, and a controller;

the faucet body having a first inlet water channel, a second inlet water channel, a third inlet water channel, a mixed water channel, and a main outlet water cavity;

an outlet end of the first inlet water channel and an outlet end of the second inlet water channel being in communication with an inlet end of the mixed water channel, an outlet end of the mixed water channel being in communication with the main outlet water cavity, an outlet end of the third inlet water channel being in movable communication with the main outlet water cavity;

the faucet spout being mounted to the faucet body, the faucet spout having a nozzle, the nozzle being in communication with the main outlet water cavity;

the mechanical control unit including a first mechanical valve core and a second mechanical valve core that are mounted to the faucet body, the first mechanical valve core and the second mechanical valve core being configured such that opening and closing of the first inlet water channel and the second inlet water channel are controlled, respectively;

the sensor control unit including a solenoid valve core mounted to the faucet body and a sensor, the solenoid valve core controlling the outlet end of the third inlet water channel for communicating with the main outlet water cavity or not, the sensor being configured such that a manual operation is sensed;

the water flow sensor being mounted to the faucet body, the water flow sensor being configured such that whether there is water flowing through the mixed water channel is detected;

the controller being electrically connected to the solenoid valve core, the sensor and the water flow sensor, respectively;

wherein when the water flow sensor detects that there is no water flowing through the mixed water channel, the controller makes the solenoid valve core control the outlet end of the third inlet water channel for communicating with the main outlet water cavity according to a signal of the sensor; when the water flow sensor detects that there is water flowing through the mixed water channel, the controller makes the sensor inactive and controls the outlet end of the third inlet water channel not for communicating with the main outlet water cavity through the solenoid valve core.

2. The dual-handle and dual-control faucet as claimed in claim 1, wherein the faucet body includes a first valve seat, a second valve seat and a water control seat;

the water control seat is provided with the first inlet water channel, the second inlet water channel, the third inlet water channel, the mixed water channel and the main outlet water cavity; a bottom of the first valve seat has a first inlet and an inner cavity communicating with the first inlet, a bottom of the second valve seat has a second inlet and an inner cavity communicating with the second inlet; the first valve seat and the second valve seat are connected to left and right sides of the water control seat respectively, the inner cavity of the first valve seat is in communication with an inlet end of the first inlet water channel, the inner cavity of the second valve seat is in communication with an inlet end of the second inlet water channel; the first mechanical valve core and the second mechanical valve core are mounted in the inner cavity of the first valve seat and the inner cavity of the second valve seat, respectively.

3. The dual-handle and dual-control faucet as claimed in claim 2, wherein the water control seat has a sensing water cavity, the sensing water cavity is in communication with the outlet end of the third inlet water channel, the sensing water cavity has a sensing outlet communicating with the main outlet water cavity;

the solenoid valve core is mounted to the water control seat, the solenoid valve core has a valve head extending into the sensing water cavity, and the valve head movably blocks the sensing outlet.

4. The dual-handle and dual-control faucet as claimed in claim 3, wherein the water control seat further has a fourth inlet water channel, and an outlet end of the fourth water inlet channel is in communication with the sensing water cavity.

5. The dual-handle and dual-control faucet as claimed in claim 4, wherein the second inlet water channel and the fourth inlet water channel are arranged side by side;

the second valve seat has a second valve seat connecting port and a second valve seat joining port that are in communication with the inner cavity of the second valve seat, the second valve seat connecting port and the second valve seat joining port are arranged side by side, and the second valve seat connecting port and the second valve seat joining port are plugged and fitted with the inlet ends of the second inlet water channel and the fourth inlet water channel, respectively.

6. The dual-handle and dual-control faucet as claimed in claim 2, wherein the first inlet water channel and the third inlet water channel are arranged side by side;

the first valve seat has a first valve seat connecting port and a first valve seat joining port that are in communication with the inner cavity of the first valve seat, the first valve seat connecting port and the first valve seat joining port are arranged side by side, and the first valve seat connecting port and the first valve seat joining port are plugged and fitted with the inlet ends of the first inlet water channel and the third inlet water channel, respectively.

7. The dual-handle and dual-control faucet as claimed in claim 2, wherein the faucet body further includes a retaining seat, the retaining seat includes two retaining sleeves and a retaining plate connected to the two retaining sleeves, the two retaining sleeves of the retaining seat are fitted onto the first valve seat and the second valve seat respectively, and the retaining plate of the retaining seat supports the water control seat.

8. The dual-handle and dual-control faucet as claimed in claim 2, wherein the water control seat includes a front seat and a rear seat connected to the front seat, the main outlet water cavity is formed between the front seat and the rear seat;

the front seat has the first inlet water channel, the second inlet water channel and the third inlet water channel that extend laterally; a rear side of the front seat is provided with a first connecting joint and a second connecting joint that are in communication with the outlet ends of the first inlet water channel and the second inlet water channel, respectively;

the rear seat has a water passage and the mixed water channel that extend laterally;

an outlet end of the water passage is in communication with the inlet end of the mixed water channel, a front side of the rear seat has a first connecting opening and a second connecting opening that are in communication with the inlet end of the water passage and the inlet end of the mixed water channel respectively, the first connecting opening and the second connecting opening are connected to the first connecting joint and the second connecting joint, respectively;

the rear seat further has a mechanical outlet communicating with the outlet end of the mixed water channel and the main outlet water cavity; left and right sides of the rear seat has a first core-pulling hole and a second core-pulling hole respectively, the first core-pulling hole and the second core-pulling hole are in communication with the water passage and the mixed water channel respectively, and the water control seat further has a first plug and a second plug configured to block the first core-pulling hole and the second core-pulling hole, respectively.

9. The dual-handle and dual-control faucet as claimed in claim 1, wherein valve stems of the first mechanical valve core and the second mechanical valve core are connected to a first handle and a second handle, respectively; a misoperation prevention unit is provided between the second mechanical valve core and the second handle.

10. The dual-handle and dual-control faucet as claimed in claim 9, wherein the misoperation prevention unit includes a stopper, a return spring, and a press member;

a valve housing of the second mechanical valve core is formed with a mounting hole, the second handle has an annular wall surrounding the second mechanical valve core, the annular wall is provided with a stopper hole; an inner end of the stopper is movably inserted into the mounting hole, an outer end of the stopper is movably inserted into the stopper hole; the return spring is received in the mounting hole and abuts against the inner end of the stopper; the press member is movably fitted to the second handle, and the press member movably presses the outer end of the stopper.

11. The dual-handle and dual-control faucet as claimed in claim 1, wherein the water flow sensor includes a magnetic impeller rotatably fitted in the mixed water channel and a Hall element mounted outside the mixed water channel, and the Hall element is electrically connected to the controller.

12. The dual-handle and dual-control faucet as claimed in claim 1, wherein the sensor is fitted to the nozzle; the sensor has two sensor probes, a sensing direction of one of the sensor probes is along a water spray direction of the nozzle, and a sensing direction of the other sensor probe is along a side of the nozzle.

* * * * *